United States Patent [19]

Ayers et al.

[11] 3,953,257

[45] Apr. 27, 1976

[54] METHOD FOR PREPARING SMALL PARTICLE SIZE COATED AMMONIUM PERCHLORATE

[75] Inventors: Orval E. Ayers; Hiram W. H. Dykes; Bernard J. Alley, all of Huntsville, Ala.

[73] Assignee: The United States of America as represented by the Secretary of the Army, Washington, D.C.

[22] Filed: Sept. 7, 1973

[21] Appl. No.: 394,889

[52] U.S. Cl. ..... 149/7; 149/76

[51] Int. Cl.[2] ..... C06B 45/34

[58] Field of Search ..... 149/7, 76

[56] References Cited

UNITED STATES PATENTS 3,539,377 11/1970 Steinle ..... 149/76 X 3,762,972 10/1973 Allen ..... 149/7

*Primary Examiner*—Leland A. Sebastian

*Attorney, Agent, or Firm*—Nathan Edelberg; Robert P. Gibson; Jack W. Voigt

[57] ABSTRACT

A method for preparing aziridine coated ammonium perchlorate (AP) of weight median diameters (WMD) ranging from about 0.25 to about 5.0 micrometers is disclosed. The method employs either an unlined stainless steel or a polyurethane lined vibro-energy grinding mill wherein a high purity aziridine compound is used as the grinding aid and the coating agent for the AP. The coated AP product extends the pot-life for hydroxyterminated polybutadiene (HTPB) propellant formulations.

6 Claims, No Drawings

METHOD FOR PREPARING SMALL PARTICLE SIZE COATED AMMONIUM PERCHLORATE

DEDICATORY CLAUSE

The invention described herein may be manufactured, used, and licensed by or for the Government for governmental purposes without the payment to us of any royalties thereon.

BACKGROUND OF THE INVENTION

Solid propellant technology has been advanced considerably during recent years because of the R & D dollars that have been expended to fund many programs devoted to the many specialized areas of solid propellant technology. For example, the burning rates of propellants have been increased by use of improved burning rate catalysts, by the use of recently developed energetic plasticizer compounds, and by the use of small particle size oxidizers.

Many problems have arisen during the development and use of small particle size oxidizers. The manufacturing of small particle size oxidizers has been difficult to accomplish, particularly, in the particle size range of 0.25 to 5.0 micrometers. The reduction in particle size of the oxidizer, ammonium perchlorate (AP), has created special problems relating to processing of propellants, particularly, the mixing of the propellant and the casting of the propellant. The major problem in mixing and casting propellants using hydroxy-terminated polybutadiene and very small particle size AP (less than 20 micrometers) relates to pot-life. Pot-life is the time during which the propellant mix retains its proper fluid properties to permit mixing and casting.

It has been determined that pot-life can be extended with the use of AP that is coated with particular aziridine compounds. Coating of very small particle size AP has been difficult to accomplish because of the tendency of the fine grind AP to stick together rather than remain separated in individual particles. The present invention is concerned with fine grind AP that is coated with an aziridine compound.

Therefore, an object of this invention is to provide a method for preparing small particle size coated ammonium perchlorate.

Another object of this invention is to provide a method for grinding and coating ammonium perchlorate with an aziridine compound.

A further object of this invention is to provide an ultrafine ammonium perchlorate that is coated with an aziridine compound and that has particle sizes ranging from about 0.25 to about 5.0 micrometers, weight median diameters, and that has specific surface areas from about 1.3 to about 13.0 $m^2/g$ (square meters per gram).

SUMMARY OF THE INVENTION

Ultrafine aziridine coated ammonium perchlorate with weight median diameters (WMD) from about 0.25 to about 5.0 micrometers is prepared in a polyurethane lined or in an unlined stainless steel vibro-energy grinding mill using high purity N-phenethylaziridine (99% plus purity) as the coating agent. Other suitable coating agents are 2,4,6 tris[1-(2-ethyl)aziridinyl] triazine and 1,3,5 benzene tri[acyl 1-(2-ethylaziridine)].

The following general procedure describes the method of this invention which is used to grind and coat AP in a vibro-energy grinding mill:

AP is weighed and charged into the mill which contains 200 pounds of grinding medium. The grinding medium consisted of ½ × ½ inch aluminum oxide ($Al_2O_3$) cylinders. However, smaller cylinders may be used as well as other types of cylinders such as zirconium oxide. N-phenethylaziridine is weighed and dissolved in a certain weight of trichlorotrifluoroethane (sold as Freon-113). The solution is added to the vibro-energy grinding mill through the port hole on the top cover. Finally, the port hole cover is put in place and the mill is operated for a specified length of time depending on the particle size AP that is being made. After completion of grinding, the AP-Freon-113 slurry is discharged from the mill into a 5-gallon aluminum container. Approximately 90% of the container opening is covered with a lid and then the container and its contents are placed in an oven at 140°F. Thus, the Freon-113 is allowed to slowly evaporate over a period of time of up to about 3 days to yield a white powder AP product with a uniform N-phenethylaziridine coating. The particle size and surface area of the AP is determined by standard MSA techniques.

DESCRIPTION OF THE PREFERRED EMBODIMENT

Grinding and coating ultrafine AP is accomplished in a polyurethane lined or in an unlined stainless steel vibro-energy grinding mill using a high purity (99% plus) N-phenethylaziridine that has been purified by vacuum distillation at 56°–59°C (1.0–1.3 torr). In the grinding and coating of the AP, either freshly distilled N-phenethylaziridine or the purified compound that has been stored over KOH pellets can be used to produce high quality coated AP. Purified N-phenethylaziridine that is stored for several days without KOH pellets undergoes a change in purity and produces poor quality coated AP.

Use of the polyurethane lined mill is preferred since comparision of the AP product produced in the polyurethane lined mill as compared to the AP product produced in the unlined stainless steel mill indicates a longer pot-life when the coated AP is used in HTPB propellant formulations. Where control of pot-life is not so critical, as in lower solids loading propellant formulations employing larger particle size AP or blended particle size AP where the average particle size is larger than 20 microns, the coated AP can be produced in an unlined mill.

The following specific examples illustrate the use of this invention in preparing small particle size AP with a uniform N-phenethylaziridine coating.

EXAMPLE I 8.0 pounds of dry unground (200 micrometers) AP were charged into the mill. A solution consisting of 30 pounds of Freon-113 and 3.63 grams (to provide a 0.1 weight % coating) N-phenethylaziridine was added to the mill. The mill was then operated for 1 hour, and the AP slurry was discharged from the mill and dried for 3 days at 140°F. MSA analyses showed the WMD of the AP particles to be 4.0–5.0 microns with a surface area of 1.1 to 1.3 $m^2/g$. Using the same grinding formulation and operating the mill for 2 hours produced 2.5–3.0 micrometers AP with a surface area of 1.3–1.5 $m^2/g$.

EXAMPLE 2

8.0 pounds of dry unground (200 micrometers) AP were charged into the mill. A solution consisting of 30 pounds of Freon-113 and 7.26 grams (to provide a 0.2 weight % coating) N-phenethylaziridine was added to the mill. The mill was operated for 24 hours and then the AP slurry was discharged and dried in an oven at 140°F for 3 days. MSA analyses showed the AP to have a WMD of 0.9–1.1 micrometers and a surface area of 3.2–3.8 $m^2/g$.

EXAMPLE 3

5.0 pounds of dry unground (200 micrometers) AP were charged into the mill. A solution consisting of 28.3 pounds of Freon-113 and 9.07 to 13.61 grams (to provide a 0.4 to 0.6 weight % coating) of N-phenethylaziridine was added to the mill. The mill was operated for 72 hours and then the AP slurry was discharged and dried in an oven at 140°F for three days. MSA analyses showed the AP to have a WMD particle size of 0.45 to 0.55 micrometer and a surface area of 6.0 to 7.3 $m^2/g$.

EXAMPLE 4

1.0 pound of dry unground (200 micrometers) AP was charged into the mill. A solution consisting of 28.3 pounds of Freon-113 and 3.18 to 4.54 grams (to provide a 0.7 to 1.0 weight % coating) of N-phenethylaziridine was added to the mill. The mill was operated for 72 hours and then the AP slurry was discharged and dried in an oven at 140°F for 3 days. MSA analyses showed the AP to have a WMD particle size of 0.25 to 0.30 micrometer and a surface area of 10.0 to 13.0 $m^2/g$.

The above example grinds were made on a Southwestern Engineering Company's SWECO vibro-energy grinding mill having a polyurethane lining and a 2.6 gallon capacity. However, this invention is not limited to a particular brand mill or to the 2.6 gallon polyurethane lined mill, but the method may be scaled-up for use in larger vibration mill, either lined or unlined, which are readily available from suppliers to the industry. Also, the drying temperature may range from 120°F to 160°F.

Other aziridine compounds in an equivalent amount may be substituted for N-phenethylaziridine to provide the percent coating in the range percent specified. For example, 2,4,6 tris[1-(2-ethyl)aziridinyl]triazine and other triazine derivatives as represented by Structure I hereinbelow may be used. Also, the compound 1,3,5 benzene tri[acyl 1-(2-ethylaziridine)] and other benzene tri acyl derivatives as represented by Structure II hereinbelow may be substituted for phenethylaziridine in Examples 1–4.

The vibro-energy grinding mill and its use is well established in the grinding art. The size reduction is accomplished as the slurry containing the courser material is passed between the grinding media which are subjected to rotational and vibrational forces.

Numerous aziridine compounds may be employed with the method of this invention. These compounds have generic structural formulae as set forth below. The compound 2,4,6 tris[1-(2-ethyl) aziridinyl]triazine is represented by Structure I. The compound 1,3,5 benzene tri[acyl 1-(2-ethylazirine)] is represented by Structure II. The compound N-phenethylaziridine is represented by Structure III.

STRUCTURE I

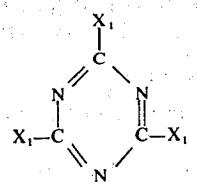

Wherein $X_1$ is an aziridine group:

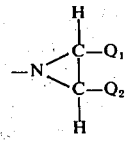

and $Q_1$ and $Q_2$ are either hydrogen or alkyl groups of one to four carbon atoms.

STRUCTURE II

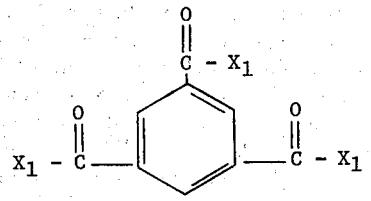

wherein $X_1$ is as described for structure I.

STRUCTURE III

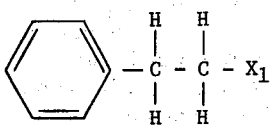

wherein $X_1$ is as described for structure I.

The aziridine group, which is a common group to all the structures, is believed to homopolymerize on the surface of the AP. Thus, the illustrations by names and structures provide guidelines for selecting other aziridine compounds which would find utility with the method of this invention.

We claim:

1. A method for preparing ultrafine particle size ammonium perchlorate that has weight median diameters ranging from about 0.25 to about 5.0 micrometers and that is coated with an aziridine compound, said method comprising:

i. charging a predetermined amount of unground ammonium perchlorate into a vibro-energy grinding mill;

ii. adding to said mill a predetermined amount of a trichlorotrifluoroethane solution of a high purity aziridine compound selected from the aziridine compounds represented by the following structures:

STRUCTURE I

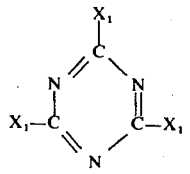

wherein $X_1$ is an aziridine group:

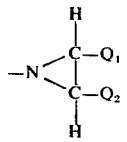

and $Q_1$ and $Q_2$ are either hydrogen or alkyl groups of one to four carbon atoms,

STRUCTURE II

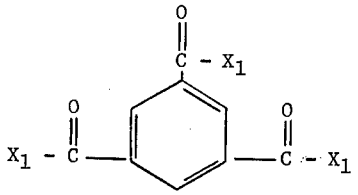

wherein $X_1$ is as described for Structure I, and

STRUCTURE III

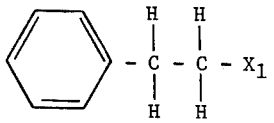

wherein X1 is as described for Structure I;

iii. operating said mill for a predetermined period of time ranging from about one hour to about 72 hours to form an ammonium perchlorate slurry;

iv. discharging said ammonium perchlorate slurry from said mill; and, v. drying said discharged ammonium perchlorate slurry at a temperature ranging from about 120°F to 160°F for a period of time of up to about 3 days to yield an ammonium perchlorate product with a uniform coating of said aziridine compound.

2. The method of claim 1 wherein said predetermined amount of ammonium perchlorate is about 8 pounds; said solution consists of 30 pounds of trichlorotrifluoroethane and 3.63 grams of said aziridine compound having Structure III and being N-phenethylaziridine; said predetermined period of time for operating said mill is about one hour; and said drying is accomplished at a temperature of about 140°F to yield said ammonium perchlorate product that has weight median diameters ranging rrom 4.0 to 5.0 micrometers, said ammonium perchlorate product having a surface area of 1.1 to 1.3 $m^2/g$.

3. The method of claim 1 wherein said predetermined amount of ammonium perchlorate is about 8 pounds; said solution consists of 30 pounds of trichlorotrifluoroethane and 3.63 grams of said aziridine compound having Structure III and being N-phenethylaziridine; said predetermined period of time for operating said mill is about two hours; and said drying is accomplished at a temperature of about 140°F to yield said ammonium perchlorate product that has weight median diameters ranging from 2.5 to 3.0 micrometers, said ammonium perchlorate product having a surface area of 1.3 to 1.5 $m^2/g$.

4. The method of claim 1 wherein said predetermined amount of ammonium perchlorate is about 8 pounds; said solution consists of 30 pounds of trichlorotrifluoroethane and 7.26 grams of said aziridine compound having Structure III and being N-phenethylaziridine; said predetermined period of time for operating said mill is about 24 hours; and said drying is accomplished at a temperature of about 140°F to yield said ammonium perchlorate product that has weight median diameters ranging from 0.9 to 1.1 micrometers, said ammonium perchlorate product having a surface area of 3.2 to 3.8 $m^2/g$.

5. The method of claim 1 wherein said predetermined amount of ammonium perchlorate is about 5 pounds; said solution consists of 28.3 pounds of trichlorotrifluoroethane and from 9.07 to 13.1 grams of said aziridine compound having Structure III and being N-phenethylaziridine; said predetermined period of time for operating said mill is about 72 hours; and said drying is accomplished at a temperature of about 140°F to yield said ammonium perchlorate product that has weight median diameters ranging from 0.45 to 0.55 micrometer, said ammonium perchlorate product having a surface area of 6.0 to 7.3 $m^2/g$.

6. The method of claim 1 wherein said predetermined amount of ammonium perchlorate is about 1.0 pound; said solution consists of 28.3 pounds of trichlorotrifluoroethane and from 3.18 to 4.54 grams of said selected aziridine compound having Structure III and being N-phenethylaziridine; said predetermined period of time for operating said mill is about 72 hours; and said drying is accomplished at a temperature of about 140°F to yield said ammonium perchlorate product that has weight median diameters ranging from 0.25 to 0.30 micrometer, said ammonium perchlorate product having a surface area of 10.0 to 13.0 $m^2/g$.

* * * * *